US008443563B2

(12) United States Patent
Schmidt

(10) Patent No.: US 8,443,563 B2
(45) Date of Patent: May 21, 2013

(54) BUILDING BLOCK HAVING THE APPEARANCE OF WOOD SHAKE

(76) Inventor: Malcolm Schmidt, Marietta, GA (US)

( * ) Notice: Subject to any disclaimer, the term of this patent is extended or adjusted under 35 U.S.C. 154(b) by 17 days.

(21) Appl. No.: 13/081,738

(22) Filed: Apr. 7, 2011

(65) Prior Publication Data

US 2011/0247289 A1 Oct. 13, 2011

Related U.S. Application Data

(60) Provisional application No. 61/322,772, filed on Apr. 9, 2010.

(51) Int. Cl.
*B44F 9/00* (2006.01)
*E04C 1/00* (2006.01)

(52) U.S. Cl.
USPC ..... 52/313

(58) Field of Classification Search
USPC ..... 52/596, 605, 606, 604, 561, 309.1, 52/309.17, 313, 503
See application file for complete search history.

(56) References Cited

U.S. PATENT DOCUMENTS

| | | | | | |
|---|---|---|---|---|---|
| 2,072,958 | A * | 3/1937 | Miller | 264/258 |
| 2,308,790 | A * | 1/1943 | Stagg | 52/550 |
| 2,392,551 | A * | 1/1946 | Roe | 52/586.2 |
| 2,990,651 | A * | 7/1961 | Chalmers | 52/541 |
| 3,643,392 | A * | 2/1972 | Martinez | 52/262 |
| 3,660,954 | A * | 5/1972 | Logan | 52/309.16 |
| 3,830,687 | A * | 8/1974 | Re et al. | 428/70 |
| 4,015,391 | A * | 4/1977 | Epstein et al. | 52/520 |
| 5,307,604 | A * | 5/1994 | Tasso | 52/745.19 |
| 5,775,047 | A * | 7/1998 | Jensen | 52/596 |
| 6,082,067 | A * | 7/2000 | Bott | 52/592.3 |
| 6,226,951 | B1 * | 5/2001 | Azar | 52/604 |
| D464,441 | S * | 10/2002 | Luaces | D25/114 |
| 6,591,569 | B2 * | 7/2003 | Azar | 52/604 |
| 6,962,028 | B2 * | 11/2005 | Banova | 52/592.5 |
| D629,919 | S * | 12/2010 | Meyer | D25/113 |
| 2003/0070386 | A1 * | 4/2003 | Hampton | 52/606 |
| 2003/0108717 | A1 * | 6/2003 | Sjoberg | 428/151 |
| 2010/0236177 | A1 * | 9/2010 | Roberts et al. | 52/404.1 |

* cited by examiner

*Primary Examiner* — Mark Wendell
*Assistant Examiner* — Keith Minter
(74) *Attorney, Agent, or Firm* — Thomas | Horstemeyer, LPP.

(57) ABSTRACT

Various systems are provided for building blocks having the appearance of wood shake. In one embodiment, a building block includes first side body portion including a protrusion, a second side body portion including a recess configured to engage the protrusion of an adjacent building block, and a front body portion including a front exterior surface having vertical striated grooved lines configured to resemble a plurality of wood shakes; and a lower lip extending across the front exterior surface and extending below a lower surface. In another embodiment, a building block includes a front exterior surface having vertical striated grooved lines configured to resemble a plurality of wood shakes and a first side body portion including a side exterior surface having vertical striated grooved lines configured to resemble at least one wood shake and a lower lip extending across the front and side exterior surfaces and extending below a lower surface.

20 Claims, 7 Drawing Sheets

BUILDING BLOCK HAVING THE APPEARANCE OF WOOD SHAKE

CROSS REFERENCE TO RELATED APPLICATIONS

This application claims priority to U.S. provisional application entitled "BUILDING BLOCK HAVING THE APPEARANCE OF WOOD SHAKE" having Ser. No. 61/322,772, filed Apr. 9, 2010, the entirety of which is hereby incorporated by reference.

BACKGROUND

Traditional building materials for covering exterior surfaces of structures have included wooden shakes, clay tiles, and metal or wooden siding. These materials have enjoyed long standing acceptance in the building market, due both to their availability and attractiveness.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
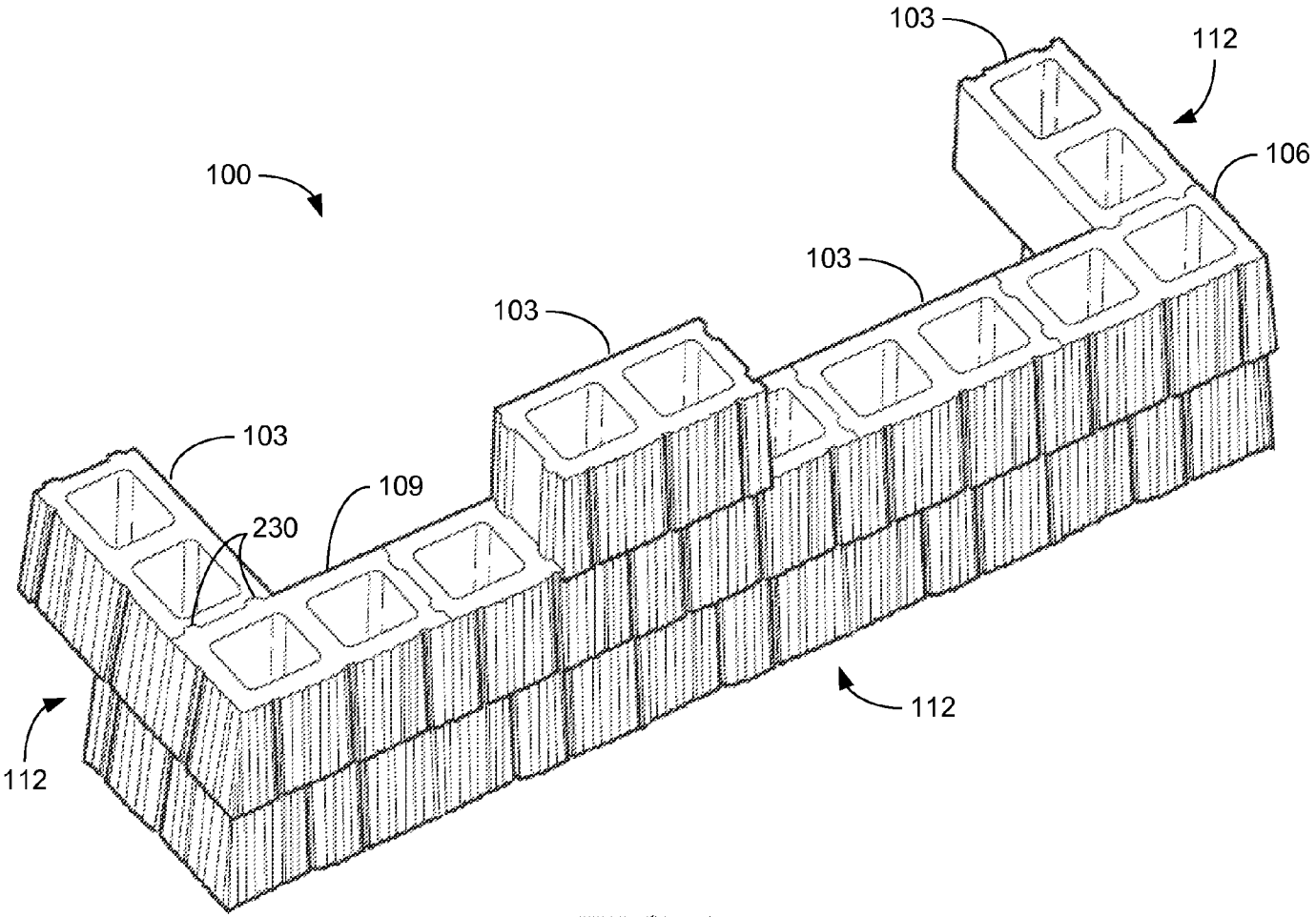
FIG. 1 is a perspective view of an example of a modular wall including building blocks having the appearance of wood shake in accordance with various embodiments of the present disclosure.

Disclosed herein are various embodiments of systems and methods related to building blocks. Reference will now be made in detail to the description of the embodiments as illustrated in the drawings, wherein like reference numbers indicate like parts throughout the several views.

Beginning with FIG. 1, shown is an example of a modular or segmental wall 100 in accordance with various embodiments of the present disclosure. Modular or segmental walls 100 commonly include courses or tiers of modular units or blocks. As depicted in FIG. 1, the wall 100 includes a plurality of building blocks 103, 106, and/or 109 having the appearance of wood shakes. The building blocks 103, 106, and/or 109 are stacked atop each other and together to form a façade or load bearing wall with an exterior surface 112 of the wall 100 having the appearance of wood shakes. Typically, the blocks 103, 106, and/or 109 are stacked in a staggered arrangement as shown in FIG. 1 to provide greater stability to the wall 100. Each building block 103, 106, and/or 109 may be bonded to one or more adjacent block 103, 106, and/or 109 by mortar, grout, or other adhesive at, e.g., the horizontal joint between courses and/or the vertical joints between blocks.

The building blocks 103, 106, and/or 109 are typically made of concrete using, e.g., molded manufacturing techniques to provide the vertical striated lines of the wood shake on at least one exterior surface of the block 103, 106, and/or 109. For example, a dry cast vibratory machine can utilize molds to produce the design and shape of the building blocks 103, 106, and/or 109. In some embodiments, the building blocks 103, 106, and/or 109 may be colored during manufacturing. In other implementations, the building blocks 103, 106, and/or 109 are colored on site. The size of the building blocks 103, 106, and/or 109 may vary within the standard sizes of the concrete products industry (e.g., ASTM C 55 and ASTM C 90). The building blocks 103, 106, and/or 109 include front and rear body portions connected by side body portions as will be discussed. The building blocks 103, 106, and/or 109 may include a celled unit construction with one or more void(s) or cavity(ies), which may be configured to accept rebar and grout to improve load bearing capabilities.

Figure 2:
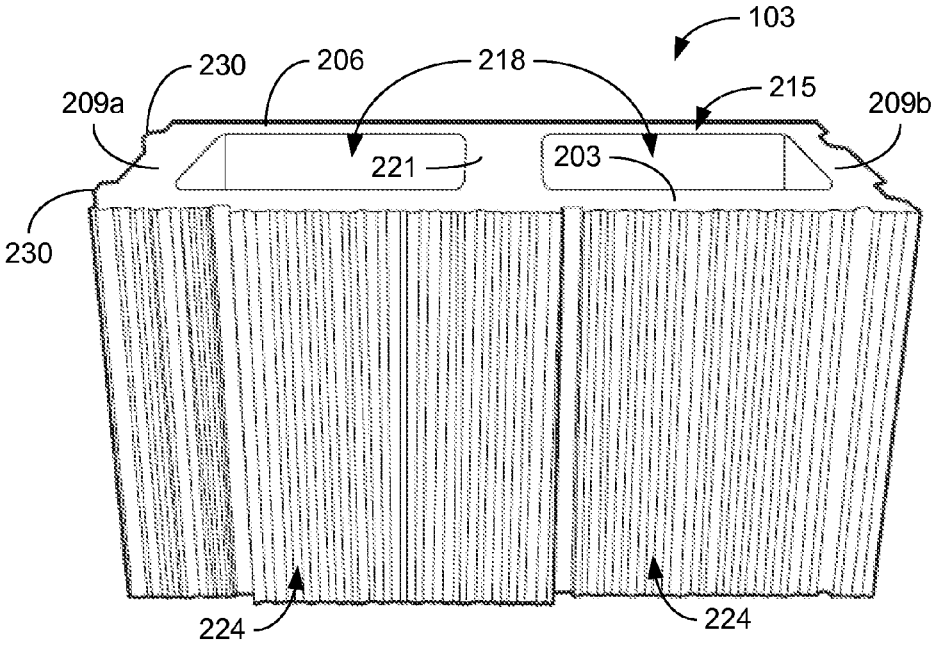
FIGS. 2-4 are perspective views of an example of a line building block used in the modular wall of FIG. 1 in accordance with various embodiments of the present disclosure.
Figure 3:
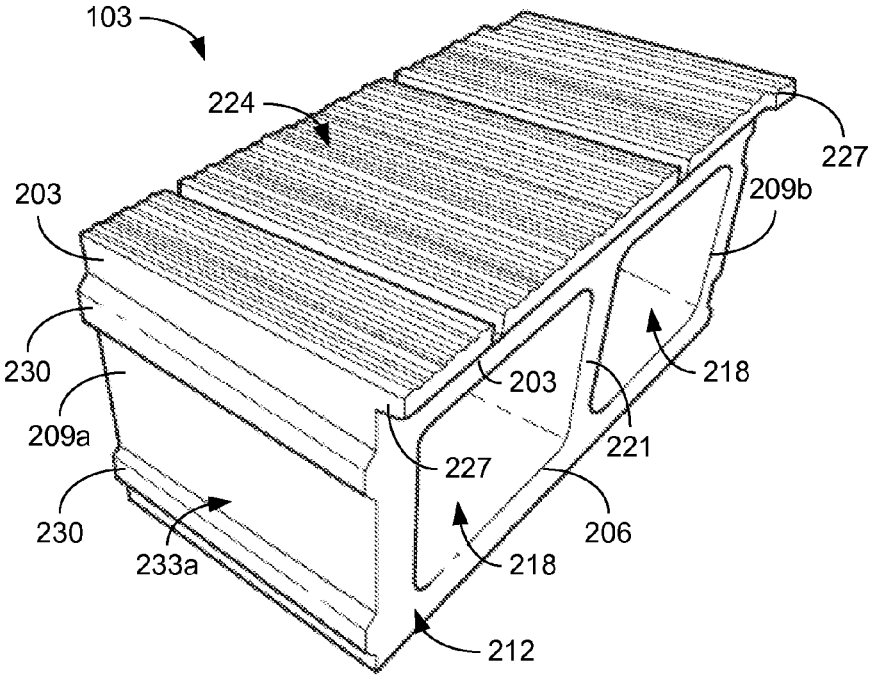
Figure 4:
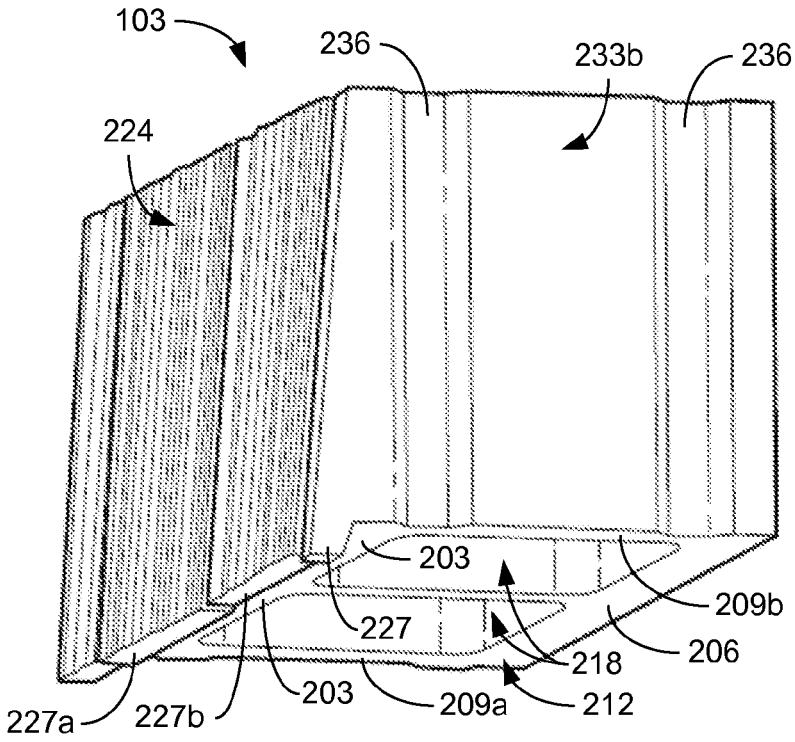

Referring next to FIGS. 2-4, shown is an example of a line building block 103 used in the modular wall 100 of FIG. 1. As illustrated in FIG. 2, the line block 103 includes a front body portion 203, a rear body portion 206, and side body portions 209 connecting the front and rear body portions 203 and 206. The front body portion 203, rear body portion 206, and side body portions 209 form a substantially planar lower surface 212 (as depicted in FIGS. 3-4) and a substantially planar upper surface 215. The line block 103 includes one or more void(s) or cavity(ies) defined by the front body portion 203, rear body portion 206, and side body portions 209. In the embodiment of FIGS. 2-4, the line block 103 includes two voids or cavities 218 separated by a central body portion 221 connected between the front and rear body portions 203 and 206. As illustrated in the cross-sectional views of FIGS. 11 and 12, the sides 1103 and 1203 of a void or cavity 218 may taper outward from the upper surface 215 to the lower surface 212. The taper is produced in the manufacturing process.

The front body portion 203 includes a front exterior surface 224 having vertical striated grooved lines configured to resemble one or more wood shakes. Variations may include different positions of the vertical grooves simulating the wood shake. For example, the striated grooved lines may be in a random configuration to simulate the appearance of a wood exterior shake. Separations between the striated grooved lines may also be provided to provide the appearance of a plurality of wood shakes. The front exterior surface 224 may extend outwardly from the top of the front exterior surface 224 (i.e., from the upper surface 215) to the bottom of the front exterior surface 224. In some implementations, a first portion of the front exterior surface 224 may extend out further than an adjacent second portion of the front exterior surface 224 to enhance the appearance of a plurality of wood shakes.

Figure 13:
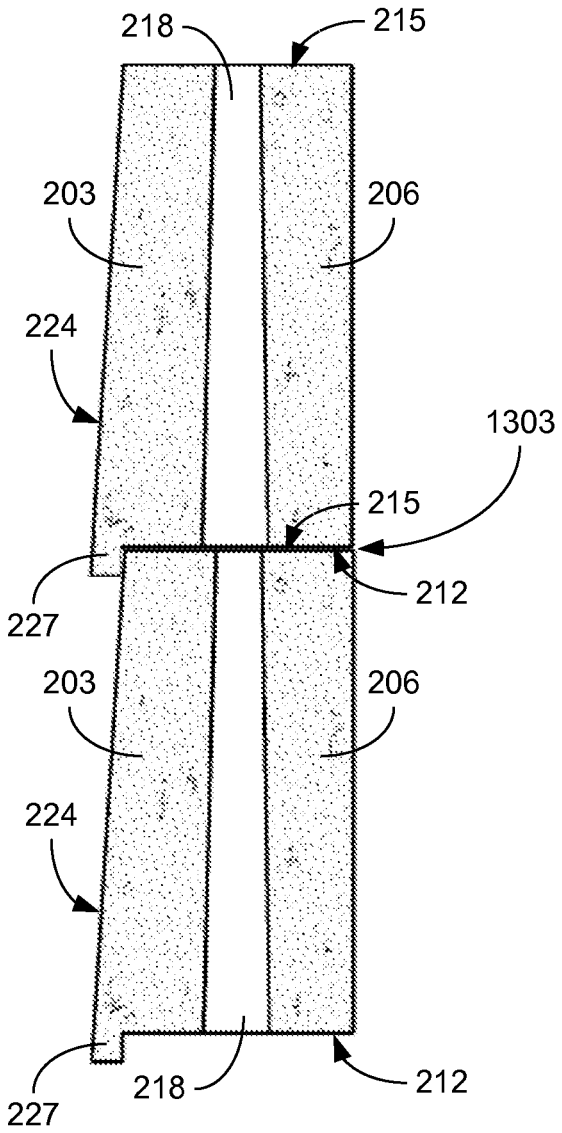
FIG. 13 is a cross-sectional view illustrating the stacking of the building blocks of FIGS. 1-7 in accordance with various embodiments of the present disclosure.

As shown in FIG. 3, the front body portion 203 also includes a lower lip 227 extending across the front exterior surface 224 and extending below the lower surface 212. In the example of FIGS. 2-4, the vertical striated grooved lines extend down the front exterior surface 224 from the upper surface 215 to the bottom of the lower lip 227. As illustrated in FIG. 13, the extension of the lower lip 227 hides the horizontal joint 1303 formed between building blocks 103, 106, and/or 109 when stacked in courses. In addition, the lower lip 227 can hide bonding material (e.g., mortar, grout, or other adhesive) applied between the courses. In some embodiments, the lower lip 227 extends a uniform distance below the lower surface 212. In other embodiments, a first portion of the lower lip 227*a* extends a first distance below the lower surface 212 and a second portion of the lower lip 227*b* extends a second distance below the lower surface 212. As depicted in FIG. 4, the first portion 227*a* may correspond to a first portion of the front exterior surface 224 that resembles a first wood shake and the second portion 227*b* may correspond to a second portion of the front exterior surface 224 that resembles a second wood shake.

Figure 9:
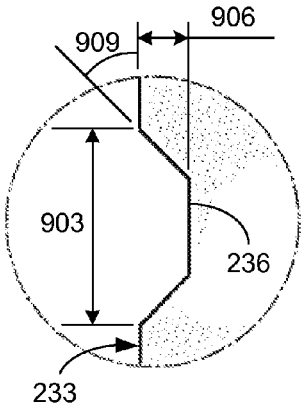
Figure 10:
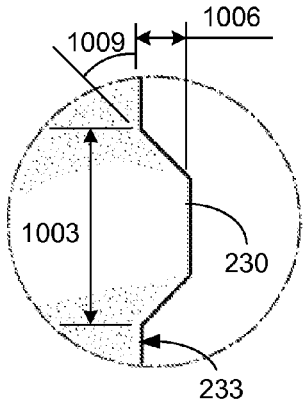

As illustrated in FIG. 3, one side body portion 209*a* includes at least one protrusion 230 that protrudes from and extends down an end surface 233*a* of the side body portion 209*a*. In the example of FIGS. 2-4, the line block 103 includes two protrusions 230. As illustrated in FIG. 4, the other side body portion 209*b* includes a recess 236 corresponding to the protrusion 230. The recess 236 recedes into and extends down an end surface 233*b* of the side body portion 209*b*. Connection between two building blocks 103, 106, and/or 109 may be achieved by aligning the protrusion(s) 230 of one block 103, 106, and/or 109 with the recess(es) 236 of an adjacent block 103, 106, and/or 109, thereby engaging protrusion(s) 230 with corresponding recess(es) 236 to interlock the two blocks 103, 106, and/or 109. In the embodiment of FIGS. 2-4, the recess 236 and protrusion 230 have a trapezoidal cross-section as illustrated in FIGS. 9 and 10, respectively. Other cross-sectional shapes (e.g., circular, triangular or rectangular) may also be used as can be understood. In some embodiments, the protrusion(s) 230 and recess(es) 236 may be proportioned for manufacturing tolerances and to allow for bonding material (e.g., mortar, grout, or other adhesive) to be applied between adjacent building blocks 103, 106, and/or 109.

Figure 5:
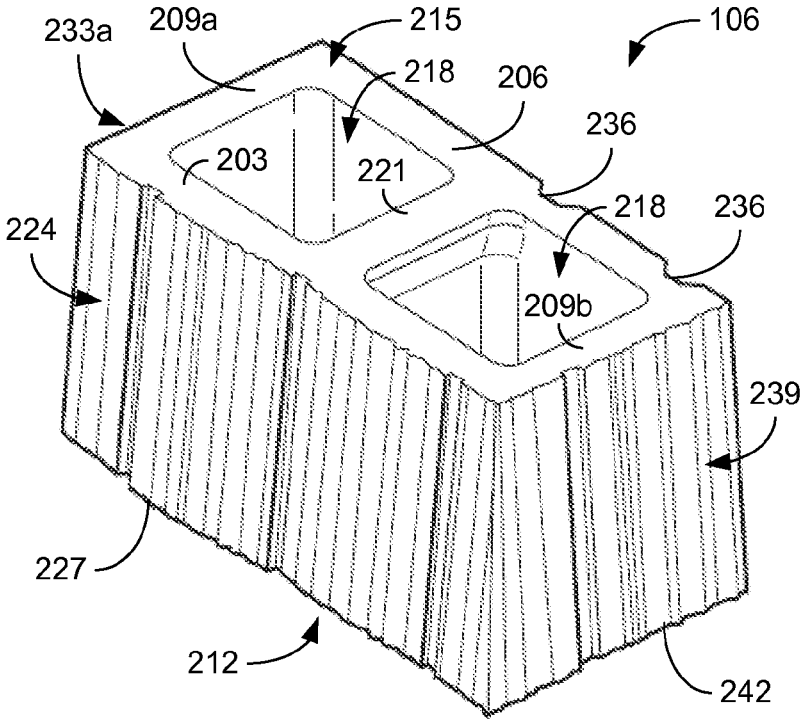
FIGS. 5-6 are perspective views of examples of corner building blocks used in the modular wall of FIG. 1 in accordance with various embodiments of the present disclosure.

Referring now to FIG. 5, shown is an example of a corner building block 106 used in the modular wall 100 of FIG. 1. As with the line block 103, the corner block 106 includes a front body portion 203, a rear body portion 206, and side body portions 209 connecting the front and rear body portions 203 and 206. The front body portion 203, rear body portion 206, and side body portions 209 form a substantially planar lower surface 212 and a substantially planar upper surface 215. The corner block 106 includes one or more void(s) or cavity(ies) 218 defined by the front body portion 203, rear body portion 206, side body portions 209, and/or central body portion 221.

The front body portion 203 includes a front exterior surface 224 having vertical striated grooved lines configured to resemble one or more wood shakes. The front body portion 203 also includes a lower lip 227 extending across the front exterior surface 224 and extending below the lower surface 212. The front exterior surface 224 may extend outwardly from the top of the front exterior surface 224 (i.e., from the upper surface 215) to the bottom of the front exterior surface 224. A first portion of the front exterior surface 224 may extend out further than an adjacent second portion of the front exterior surface 224 to enhance the appearance of a plurality of wood shakes. In some embodiments, the lower lip 227 may extend a uniform distance below the lower surface 212. In other embodiments, a first portion of the lower lip 227 extends a first distance below the lower surface 212 and a second portion of the lower lip 227 extends a second distance below the lower surface 212.

In the embodiment of FIG. 5, side body portion 209*b* includes a side exterior surface 239 having vertical striated grooved lines configured to resemble one or more wood shakes. The side body portion 209*b* also includes a lower lip 242 extending across the side exterior surface 239 and extending below the lower surface 212. The side exterior surface 239 may extend outwardly from the top of the side exterior surface 239 (i.e., from the upper surface 215) to the bottom of the side exterior surface 239. A first portion of the side exterior surface 239 may extend out further than an adjacent second portion of the side exterior surface 239 to enhance the appearance of a plurality of wood shakes. In some embodiments, the lower lip 242 may extend the same uniform distance below the lower surface 212 as lower lip 227. In other embodiments, a first portion of the lower lip 242 extends a first distance below the lower surface 212 and a second portion of the lower lip 242 extends a second distance below the lower surface 212. As illustrated in FIG. 5, the lower lip 227 extending over at least a portion of the front exterior surface 224 adjacent to the side exterior surface 239 and the lower lip 242 extending over at least a portion of the side exterior surface 239 adjacent to the front exterior surface 224 may extend the same distance below the lower surface 212.

In the embodiment of FIG. 5, the other side body portion 209*a* includes an end surface 233*a* that is free of protrusions 230 or recesses 236. In other embodiments, such as the corner block 106 illustrated in FIG. 1, the other side portion 209*a* includes at least one protrusion 230 that protrudes from and extends down the end surface 233*a* of the side body portion 209*a*. The rear body portion 206 includes at least one recess 236. The recess 236 recedes into and extends down a back surface of the rear body portion 206. As shown in FIG. 5, the recesses 236 are offset to align with the protrusions 230 of another building block 103, 106, and/or 109, thereby aligning the side exterior surface 239 of the corner building block 106 with the front exterior surface 224 of the other building block. Connection between two building blocks 103, 106, and/or 109 may be achieved by aligning the protrusion(s) 230 of one block 103, 106, and/or 109 with the recess(es) 236 of an adjacent block 103, 106, and/or 109, thereby engaging protrusion(s) 230 with corresponding recess(es) 236 to interlock the two blocks 103, 106, and/or 109.

Figure 6:
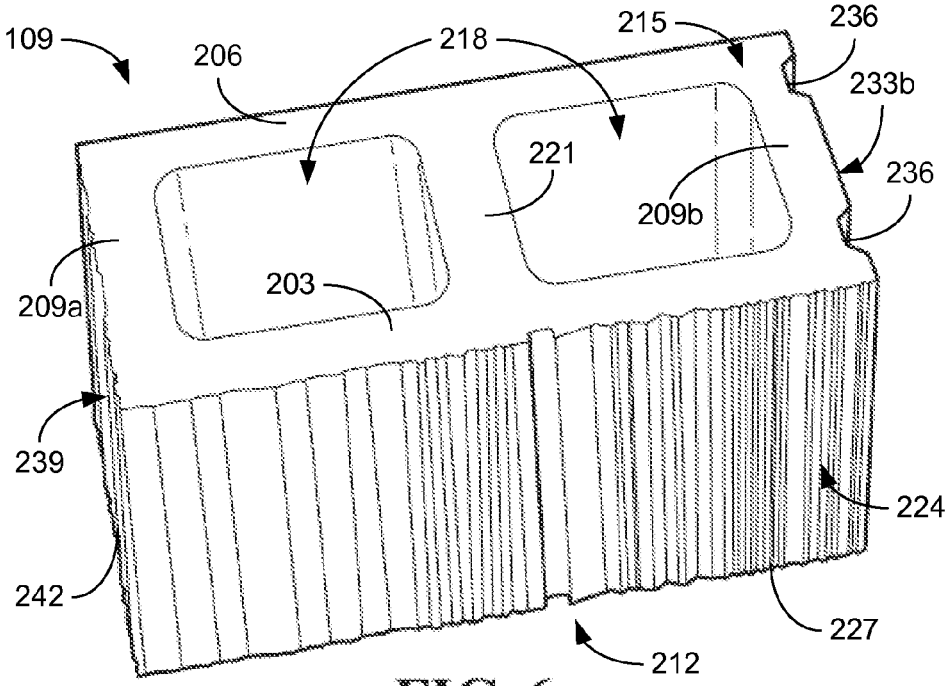

Referring next to FIG. 6, shown is another example of a corner building block 109 used in the modular wall 100 of FIG. 1. The corner block 109 includes a front body portion 203, a rear body portion 206, and side body portions 209 connecting the front and rear body portions 203 and 206. The front body portion 203, rear body portion 206, and side body portions 209 form a substantially planar lower surface 212 and a substantially planar upper surface 215. The corner block 109 includes one or more void(s) or cavity(ies) 218 defined by the front body portion 203, rear body portion 206, side body portions 209, and/or central body portion 221.

The front body portion 203 includes a front exterior surface 224 having vertical striated grooved lines configured to resemble one or more wood shakes. The front body portion 203 also includes a lower lip 227 extending across the front exterior surface 224 and extending below the lower surface 212. The front exterior surface 224 may extend outwardly from the top of the front exterior surface 224 (i.e., from the upper surface 215) to the bottom of the front exterior surface 224. A first portion of the front exterior surface 224 may extend out further than an adjacent second portion of the front exterior surface 224 to enhance the appearance of a plurality of wood shakes. In some embodiments, the lower lip 227 may extend a uniform distance below the lower surface 212. In other embodiments, a first portion of the lower lip 227 extends a first distance below the lower surface 212 and a second portion of the lower lip 227 extends a second distance below the lower surface 212.

In the embodiment of FIG. 6, side body portion 209*a* includes a side exterior surface 239 having vertical striated grooved lines configured to resemble one or more wood shakes. The side body portion 209*a* also includes a lower lip 242 extending across the side exterior surface 239 and extending below the lower surface 212. The side exterior surface 239 may extend outwardly from the top of the side exterior surface 239 (i.e., from the upper surface 215) to the bottom of the side exterior surface 239. A first portion of the side exterior surface 239 may extend out further than an adjacent second portion of the side exterior surface 239 to enhance the appearance of a plurality of wood shakes. In some embodiments, the lower lip 242 may extend the same uniform distance below the lower surface 212 as lower lip 227. In other embodiments, a first portion of the lower lip 242 extends a first distance below the lower surface 212 and a second portion of the lower lip 242 extends a second distance below the lower surface 212. As illustrated in FIG. 6, the lower lip 227 extending over at least a portion of the front exterior surface 224 adjacent to the side exterior surface 239 and the lower lip 242 extending over at least a portion of the side exterior surface 239 adjacent to the front exterior surface 224 may extend the same distance below the lower surface 212.

In the embodiment of FIG. 6, the other side body portion 209*b* includes an end surface 233*b* that includes at least one recess 236. The recess 236 recedes into and extends down the end surface 233*b* of the side body portion 209*b*. The rear body portion 206 includes a back surface that is free of protrusions 230 or recesses 236. In other embodiments, such as the corner block 109 illustrated in FIG. 1, the rear body portion 206 includes at least one protrusion 230 that protrudes from and extends down the back surface of the rear body portion 206. As shown in FIG. 1, the protrusions 230 are offset to align with the recesses 236 of another building block 103, 106, and/or 109, thereby aligning the side exterior surface 239 of the corner building block 109 with the front exterior surface 224 of the other building block. Connection between two building blocks 103, 106, and/or 109 may be achieved by aligning the protrusion(s) 230 of one block 103, 106, and/or 109 with the recess(es) 236 of an adjacent block 103, 106, and/or 109, thereby engaging protrusion(s) 230 with corresponding recess(es) 236 to interlock the two blocks 103, 106, and/or 109.

The building blocks 103, 106, and/or 109 of FIGS. 2-6 illustrate blocks used to form a load bearing wall. The size of the building blocks 103, 106, and/or 109 may vary within the standard sizes of the concrete products industry. For example, building blocks 103, 106, and/or 109 may be standard 8×8×16 blocks. As illustrated in FIG. 9, the recesses 236 may have a trapezoidal cross-section with an opening width 903 at the end surface 233 of about 1 inch, a depth 906 of about 0.25 inch, and side angles 909 of about 45 degrees. The protrusions 230 may be proportioned to take into account manufacturing tolerances and to allow for bonding material to be applied between adjacent building blocks 103, 106, and/or 109. For example, as illustrated in FIG. 10, the protrusions 130 may have a trapezoidal cross-section with a width 1003 at the end surface 233 of about 0.938 inch, a depth 1006 of about 0.188 inch, and side angles 1009 of about 45 degrees. In the embodiments of FIGS. 2-6, the protrusions 230 and recesses 236 may be spaced apart about 4.5 inches (center-to-center) for standard 8×8×16 blocks. Other shapes and sizes may be utilized as can be understood. In addition, in some embodiments, the front exterior surface 224 and/or side exterior surface 239 may extend about 0.5 inch from the upper surface 215 to the lower surface 212 with the lower lip 227 and/or 242 having a corresponding depth of about 0.5 inch.

Figure 7:
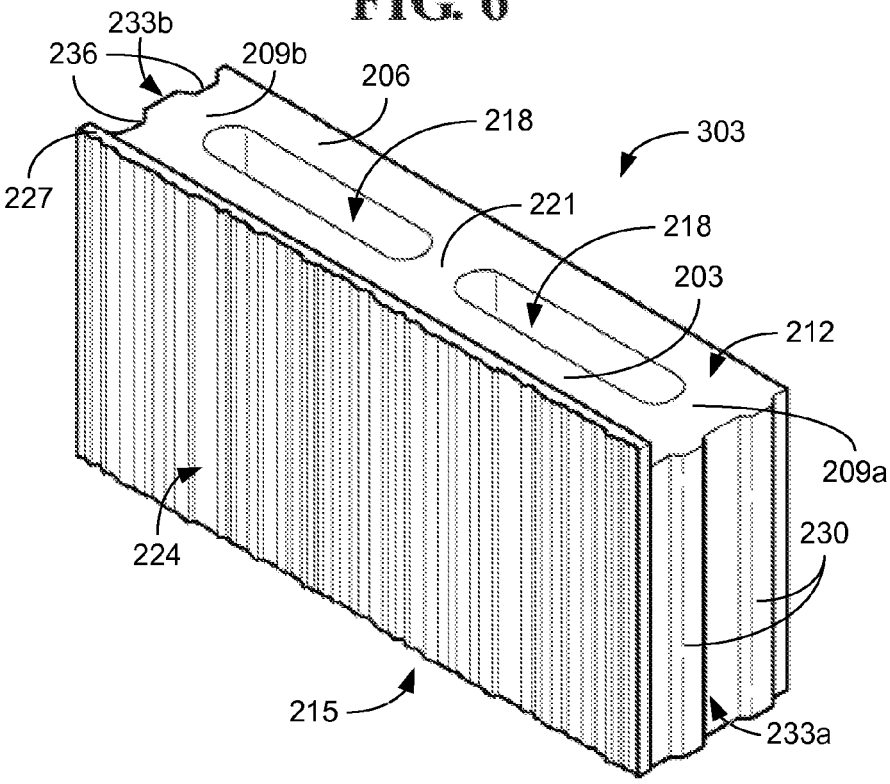
FIG. 7 is a perspective views of another example of a line building block used in a modular wall in accordance with various embodiments of the present disclosure.

Referring now to FIG. 7, shown is perspective view of the bottom of an example of a line building block 303 that may be used to form a building façade. As with the line block 103, line block 303 includes a front body portion 203, a rear body portion 206, and side body portions 209 connecting the front and rear body portions 203 and 206. The front body portion 203, rear body portion 206, and side body portions 209 form a substantially planar lower surface 212 and a substantially planar upper surface 215. The line block 303 includes one or more void or cavity 218 defined by the front body portion 203, rear body portion 206, side body portions 209, and/or central body portion 221.

The front body portion 203 includes a front exterior surface 224 having vertical striated grooved lines configured to resemble one or more wood shakes. The front body portion 203 also includes a lower lip 227 extending across the front exterior surface 224 and extending below the lower surface 212. The front exterior surface 224 may extend outwardly from the top of the front exterior surface 224 (i.e., from the upper surface 215) to the bottom of the front exterior surface 224. A first portion of the front exterior surface 224 may extend out further than an adjacent second portion of the front exterior surface 224 to enhance the appearance of a plurality of wood shakes. In some embodiments, the lower lip 227 may extend a uniform distance below the lower surface 212 as depicted in FIG. 7. In other embodiments, a first portion of the lower lip 227 extends a first distance below the lower surface 212 and a second portion of the lower lip 227 extends a second distance below the lower surface 212.

Figure 8:
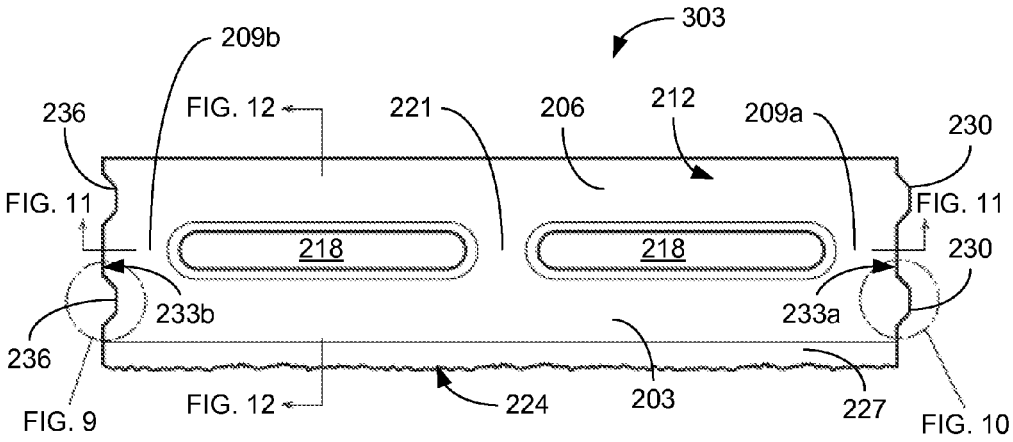
FIGS. 8-12 are views illustrating various features of the building blocks of FIGS. 1-7 in accordance with various embodiments of the present disclosure.

One side body portion 209*a* includes at least one protrusion 230 that protrudes from and extends down an end surface 233*a* of the side body portion 209*a*. In the example of FIG. 7, the line block 303 includes two protrusions 230. As illustrated in FIGS. 7-8, the other side body portion 209*b* includes a recess 236 corresponding to the protrusion 230. The recess 236 recedes into and extends down an end surface 233*b* of the side body portion 209*b*. Corner building blocks may also include elements as described with respect to FIGS. 5 and 6. Connection between two building blocks may be achieved by aligning the protrusion(s) 230 of one block with the recess(es) 236 of an adjacent block, thereby engaging protrusion(s) 230 with corresponding recess(es) 236 to interlock the two blocks.

Referring to FIG. 8, shown is a bottom view of the building block 303 of FIG. 7. The size of the building block 303 and associated corner blocks may vary within the standard sizes of the concrete products industry. For example, building block 303 may be standard 4×8×16 block. As illustrated in FIG. 9, the recesses 236 may have a trapezoidal cross-section with an opening width 903 at the end surface 233 of about 1 inch, a depth 906 of about 0.25 inch, and side angles 909 of about 45 degrees. The protrusions 230 may be proportioned to take into account manufacturing tolerances and to allow for bonding material to be applied between adjacent building blocks. For example, as illustrated in FIG. 10, the protrusions 130 may have a trapezoidal cross-section with a width 1003 at the end surface 233 of about 0.938 inch, a depth 1006 of about 0.188 inch, and side angles 1009 of about 45 degrees. In the embodiments of FIGS. 7-8, the protrusions 230 and recesses 236 may be spaced apart about 2 inches (center-to-center) for standard 4×8×16 blocks. Other shapes and sizes may be utilized as can be understood. In addition, in some embodiments, the front exterior surface 224 and/or side exterior surface 239 may extend about 0.5 inch from the upper surface 215 to the lower surface 212 with the lower lip 227 and/or 242 having a corresponding depth of about 0.5 inch.

Figure 11:
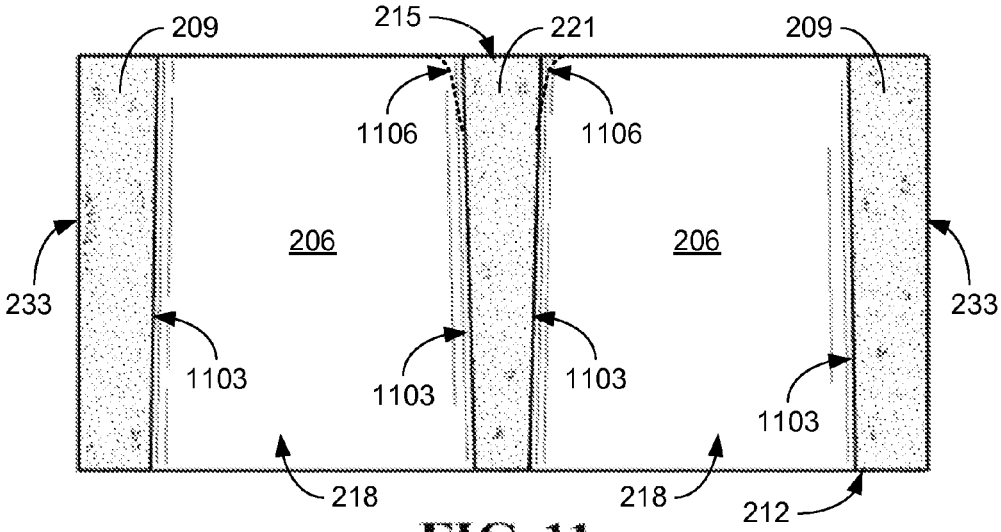
Figure 12:
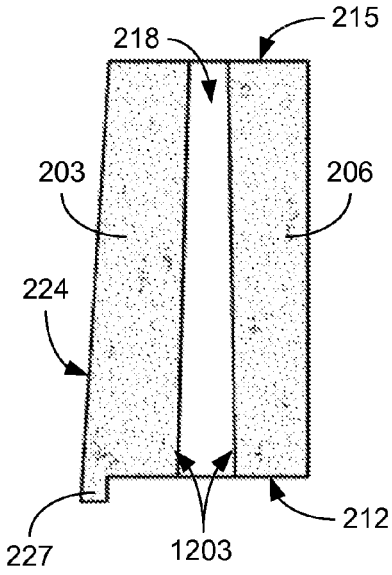

While FIG. 8 shows building block 303 of FIG. 7, the building block features of FIG. 8 are equally applicable to the building blocks 103, 106, and/or 109 of FIGS. 2-6. For example, the building blocks 103, 106, and/or 109 and building block 303 may utilize the same dimensions for protrusions 230 and recesses 236 as illustrated in FIGS. 9 and 10. In addition, as illustrated in the cross-sectional views of FIGS. 11 and 12 respectively, the sides 1103 and 1203 of the void or cavity 218 may taper outward from the upper surface 215 to the lower surface 212. In some embodiments, the central body portion 221 may include a further extension 1106 that protrudes into the void or cavity 218 at the upper surface 215 as illustrated in FIG. 11.

Referring next to FIG. 13, shown is a cross-sectional view illustrating the stacking of the building blocks, such as blocks 103, 106, 109, and/or 303 of FIGS. 1-7, in accordance with various embodiments of the present disclosure. The building blocks are stacked atop each other in courses or tiers and together to form a façade or load bearing wall. As illustrated in FIG. 13, the extension of the lower lip 227 hides the horizontal joint 1303 formed between building blocks when stacked in courses. Each building block may be bonded to one or more adjacent block by bonding material (e.g., mortar, grout, or other adhesive) at, e.g., the horizontal joint 1303 between courses. The lower lip 227 can also hide the bonding material applied between the courses.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, at least the following is claimed:

1. A building block, comprising:

a first side body portion including a protrusion;

a second side body portion including a recess configured to engage a protrusion of an adjacent building block;

front and rear body portions connected by the first and second side body portions, the front body portion including:

a front exterior surface comprising a plurality of portions having vertical striated grooved lines, the plurality of portions configured to resemble a plurality of wood shakes; and a lower lip extending across the front exterior surface and extending below a substantially planar lower surface formed by the front, rear, first and second side body portions, where a first portion of the lower lip corresponding to a first portion of the front exterior extends a first distance below the lower surface and a second portion of the lower lip corresponding to a second portion of the front exterior extends a second distance different from the first distance below the lower surface.

2. The building block of claim 1, wherein the first portion of the front exterior and the second portion of the front exterior are separated by a vertical separation groove.

3. The building block of claim 1, wherein the first portion of the front exterior surface resembles a first wood shake and the second portion of the front exterior surface resembles a second wood shake adjacent to the first portion of the front exterior surface.

4. The building block of claim 1, wherein the first side body portion including a second protrusion and the second side body portion including a second recess configured to engage the second protrusion of the adjacent building block.

5. The building block of claim 4, wherein a first portion of the front exterior surface resembles a first wood shake and a second portion of the front exterior surface resembles a second wood shake, where the first portion of the front exterior surface extends outwardly at a first slope and the second portion of the front exterior surface extends outwardly at a second slope.

6. The building block of claim 1, wherein the front exterior surface extends outwardly from the top of the front exterior surface to the bottom of the front exterior surface.

7. A wall including a plurality of building blocks of claim 1, the wall comprising:

a first course including a first building block of the plurality of building blocks adjacent to a second building block of the plurality of building blocks, where the recess of the first building block is engaged with the protrusion of the second building block; and a second course resting on top of said first course, the second course including a third building block of the plurality of building blocks resting on top at least a portion of the first building block and at least a portion of the second building block, the lower lip of the third building block extending below the top of the front exterior surfaces of the first and second building blocks.

8. The wall of claim 7, further including a layer of mortar between the building blocks of the first and second courses.

9. A building block, comprising:

front and rear body portions connected by first and second side body portions, the front body portion including a front exterior surface comprising a plurality of portions having vertical striated grooved lines, the plurality of portions configured to resemble a plurality of wood shakes and the first side body portion including a side exterior surface comprising at least one portion having vertical striated grooved lines the at least one portion configured to resemble at least one wood shake; and a lower lip extending across the front and side exterior surfaces and extending below a substantially planar lower surface formed by the front, rear, first and second side body portions, where a first portion of the lower lip corresponding to a first portion of the front exterior extends a first distance below the lower surface and a second portion of the lower lip corresponding to a second portion of the front exterior extends a second distance different from the first distance below the lower surface.

10. The building block of claim 9, wherein the first portion of the front exterior and the second portion of the front exterior are separated by a vertical separation groove.

11. The building block of claim 9, wherein the first portion of the front exterior surface resembles a first wood shake and the second portion of the front exterior surface resembles a second wood shake adjacent to the first portion of the front exterior surface.

12. The building block of claim 11, wherein the first portion of the front exterior surface is adjacent to the at least one portion of the side exterior surface and the first portion of the lower lip corresponds to the first portion of the front exterior surface and the at least one portion of the side exterior surface.

13. The building block of claim 11, wherein the first portion of the front exterior surface extends outward to a first depth and the second portion of the front exterior surface extends outward to a second depth.

14. The building block of claim 9, wherein the first portion of the front exterior surface extends outwardly from the top of the front exterior surface to the bottom of the front exterior surface and the at least one portion of the side exterior surface extends outwardly from the top of the side exterior surface to the bottom of the side exterior surface.

15. The building block of claim 9, wherein the rear side body portion includes a recess configured to engage a protrusion of an adjacent building block of claim 1.

16. The building block of claim 15, wherein the second side body portion includes a protrusion.

17. The building block of claim 9, wherein the second side body portion includes a recess configured to engage a protrusion of an adjacent building block of claim 1.

18. The building block of claim 17, wherein the rear side body portion includes a protrusion.

19. The building block of claim 9, wherein the side exterior surface comprises a second portion having vertical striated grooved lines, the second portion configured to resemble a wood shake.

20. The building block of claim 9, wherein the first portion and the second portion of the side exterior surface are separated by a vertical separation groove.

* * * * *